US005195551A

United States Patent [19]

Ju

[11] Patent Number: 5,195,551

[45] Date of Patent: Mar. 23, 1993

[54] DEVICE FOR PREVENTING FOLDING OF A LOWER JOINT FOR A ONE TOUCH TYPE DOME SHAPED TENT

[75] Inventor: Dong-Soo Ju, Seoul, Rep. of Korea

[73] Assignee: Bae Jin Corporation, Seoul, Rep. of Korea

[21] Appl. No.: 717,684

[22] Filed: Jun. 19, 1991

[30] Foreign Application Priority Data

Apr. 4, 1991 [KR] Rep. of Korea ..... 91-4601

[51] Int. Cl.[5] ..... E04H 15/36

[52] U.S. Cl. ..... 135/102; 135/106; 403/61; 403/101

[58] Field of Search ..... 135/102, 109, 87, 104, 135/106, 112; 403/61, 101, 102

[56] References Cited

U.S. PATENT DOCUMENTS

| | | | |
|---|---|---|---|
| 807,768 | 12/1905 | Otis | 403/61 X |
| 1,039,986 | 10/1912 | Merritt | 403/61 |
| 1,121,977 | 12/1914 | Clark | 403/102 X |
| 1,196,952 | 9/1916 | Hubbard | 403/102 X |
| 1,303,846 | 5/1919 | Blauvelt | 403/61 |
| 3,184,261 | 5/1965 | Young | 403/102 X |
| 4,393,541 | 7/1983 | Hujsak et al. | 403/102 X |
| 4,750,509 | 6/1988 | Kim | 135/102 |
| 4,850,069 | 7/1989 | Harper | 403/61 X |
| 5,023,968 | 6/1991 | Diehl et al. | 403/102 X |
| 5,058,844 | 10/1991 | Webb | 403/61 X |

*Primary Examiner*—Richard E. Chilcot, Jr.
*Assistant Examiner*—Lan M. Mai
*Attorney, Agent, or Firm*—Donald C. Feix

[57] ABSTRACT

A device for preventing folding of a lower joint for a one touch type dome shaped tent is disclosed. If the upper joint is locked or released, the lower joint is also locked or released automatically. A connecting portion of the lower joint is provided with a round projection and with an elongate slot, and the middle segment is provided with a socket and a supporting step, in such a manner that the round projection can be mounted upon the supporting step. Further a coil spring is installed on the neck portion of the lower segment so that the leading end of the coil spring should able to push the tip of the socket.

2 Claims, 2 Drawing Sheets

FIG.1
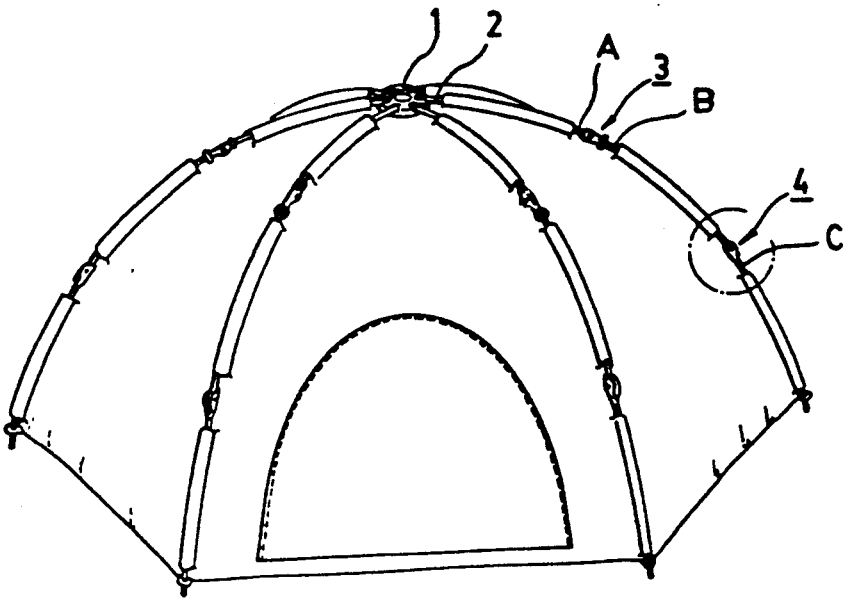
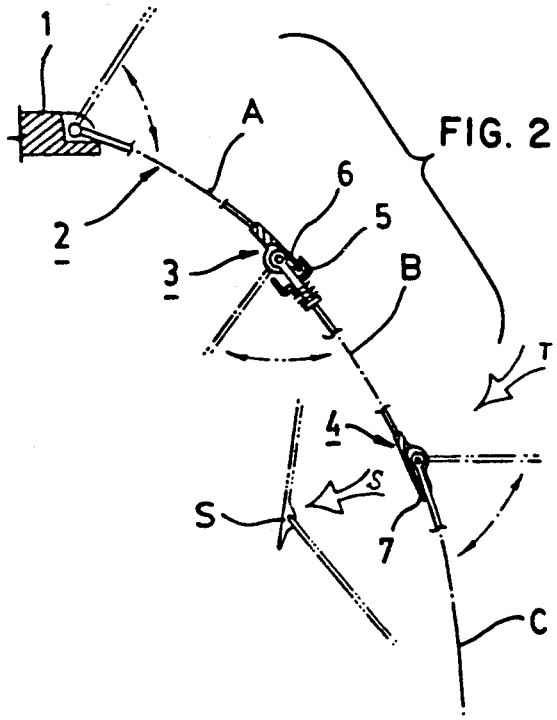
FIG. 2
FIG.3
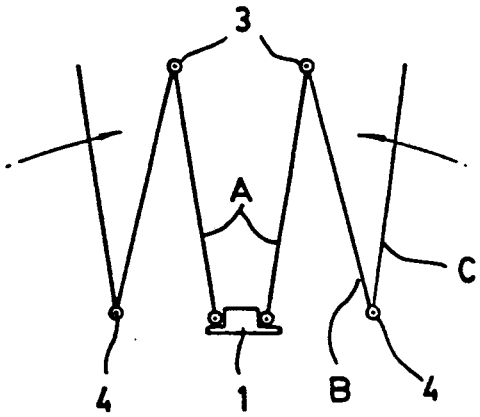

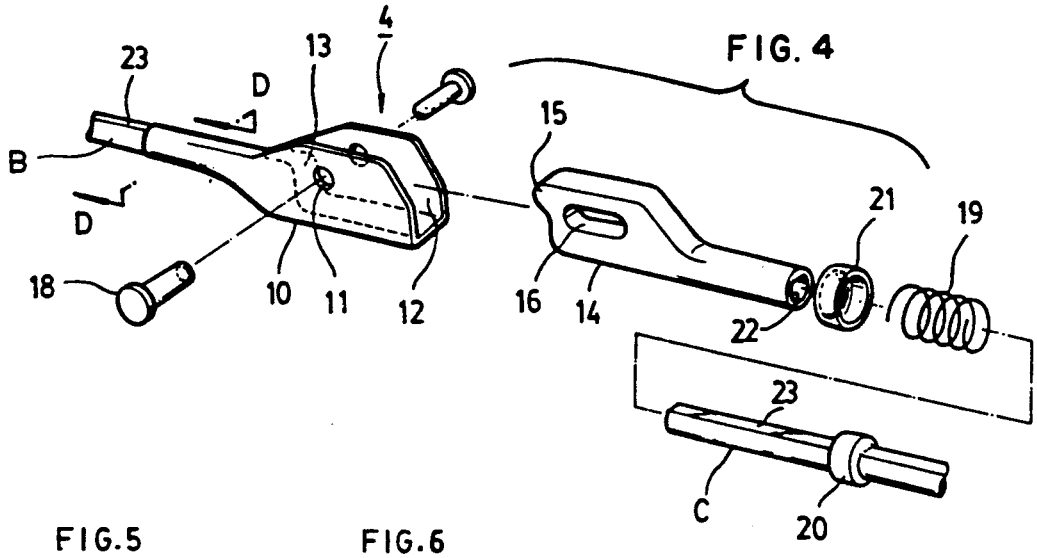
FIG.5
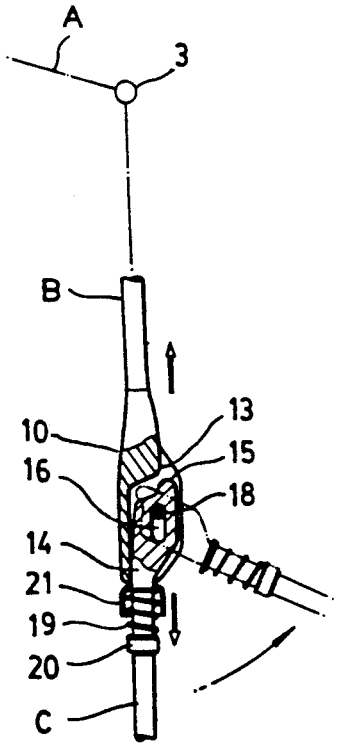
FIG.6
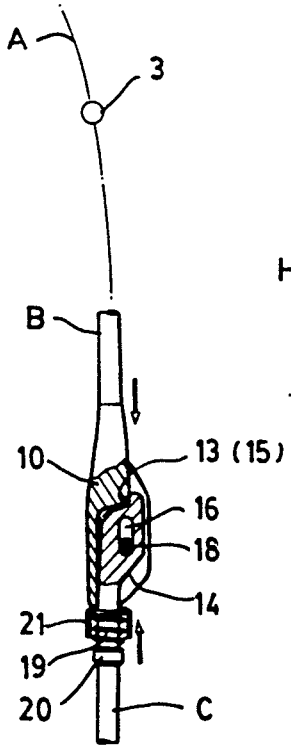
FIG.7
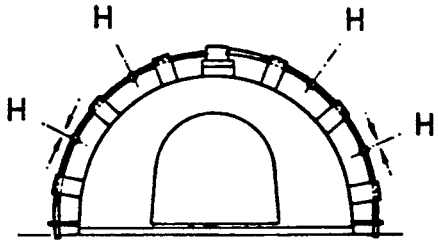
FIG.8
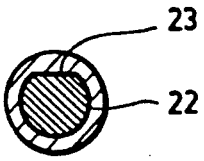

DEVICE FOR PREVENTING FOLDING OF A LOWER JOINT FOR A ONE TOUCH TYPE DOME SHAPED TENT

FIELD OF THE INVENTION

The present invention relates to a device for preventing folding of a lower joint for a one touch type dome shaped tent of the kind in which the folding portions can be conveniently folded and spread like the usual automatic umbrellas.

The present invention particularly relates to a device for preventing folding of a lower joint for a one touch type dome shaped tent in which the upper joints and the lower joints are locked simultaneously if the tent is spread. As long as the tent is not folded, the lower joints are not folded but will maintain the spread state under any external forces applied, while, if the upper joints are folded in order to fold up the tent, the lower joints are folded in a spontaneous manner.

BACKGROUND OF THE INVENTION

The conventional one touch type dome shaped tent is illustrated in FIGS. 1 to 3, and the structure shown in these drawings is the basis for applying the device of the present invention.

FIG. 1 is a perspective view showing the structure of the spread state of the conventional one touch type dome shaped tent. As shown in this drawing, frame members 2 are joined to a hub 1 of the central peak of the tent, and the frame members 2 extend in all directions from the hub 1, thus the hub 1 forms an easily foldable central joint.

Each of the frame members 2 consists of an upper segment A, a middle segment B and a lower segment C. The three segments are joined into an integrated member, while each of the joining portions is provided with a hinge. Among the three segments, the upper segment A and the middle segment B are joined at an upper joint 3 in the form of it, which the middle segment B and the lower segment C are connected at a lower joint 4 in the form of V. Thus the upper and lower joints 3, 4 perform folding movements in mutually opposite directions, in such a manner that one whole frame member 2 should form a zig-zag shape, as shown in FIG. 3.

Further, as shown in FIG. 2, the upper joint 3 is provided with a locking cap 5 to secure the end portion 6 of the joint and to prevent inadvertent folding. If the locking cap 5 is pushed down, the locked state is released, so that the upper joint 3 can be folded in the form of it. In contrast to this, the lower joint 4 is not provided with such a locking device, but is provided with only a pivotal structure. But an end portion 7 of the joint supports the lower segment C so that the lower segment C can be folded only outwardly. Thus, if the tent is spread, the frame members are bent like a bow as shown in FIG. 2, while if the tent is folded, the frame members are folded in the form of V.

However, it has been proved through experience that the conventional one touch type dome shaped tent having the above described structure has problems yet to be solved. That is, there is no locking device on the lower joint 4. If a slight pushing force is applied when the tent is spread, the lower joint 4 can be inwardly folded as shown by an imaginary line S of FIG. 2, thereby making the tent collapse. Examples of such external forces T are an abrupt, strong wind; intrusion caused by children playing; kicking by a nocturnal walker and the like.

In an attempt to overcome the above described problems, a locking device may be provided also to the lower joint 4. However, in that case, the problem is that both the upper and lower locking devices have to be operated one by one by hand. Such a matter hurts the originally intended feature of the one touch type dome shaped tent which aims at the convenience and speediness of the folding operation. If one manipulation of the upper joint 3 causes the lower joint 4 to be operated (i.e., locked or released), it will be satisfactory; but, so far, such a device has not been invented.

Another problem lies in the joining between the joint and the frame member. Conventionally, the hole of the joint portion has a circular cross section, and the frame member also has a circular cross section. Therefore, even if the frame member is press-fitted into the hole of the joint portion, a clearance appears between the frame member and the hole. The result is that the frame members can be twisted, thereby bringing problems to folding or spreading the tent.

SUMMARY OF THE INVENTION

The present invention is intended to overcome the above described disadvantages of the conventional one touch type dome shaped tent.

Therefore, it is the object of the present invention to provide a device to prevent the folding of a lower joint for a one touch type dome shaped tent in which the cross sections of both the frame member and the hole of the joint portion can collapse into a straight line at some portion thereof, and a locking device is provided also to the lower joint in such a manner that both the upper and lower joints can be locked or released with only one touch manipulation.

In achieving the above object, the lower frame segment which is connected to the lower joint is provided in an advanceable and withdrawable manner, and the movability of the lower segment is supported by an elastic means.

BRIEF DESCRIPTION OF THE DRAWING VIEWS

The above object and other advantages of the present invention will become more apparent by describing in detail the preferred embodiment of the present invention with reference to the attached drawings in which:

FIG. 1 is a perspective view showing the constitution of the conventional one touch type dome shaped tent;

FIG. 2 illustrates the constitution of the joint and the folded state of the conventional tent;

FIG. 3 illustrates the folding shape of the conventional tent;

FIG. 4 is an exploded perspective view showing the constitution of the lower joint portion of the frame member according the present invention;

FIG. 5 illustrates a state in which the locking state of the lower joint is automatically released when folding the tent;

FIG. 6 illustrates a state in which the lower joint portion is automatically locked when spreading the tent;

FIG. 7 illustrates a state in which the frame members exert forces toward the joining portions each other when the tent is spread; and FIG. 8 is an enlarged sectional view showing the cross section of the line D—D of FIG. 4.

DESCRIPTION OF THE PREFERRED EMBODIMENT

As shown in the drawings, frame members 2 are extended in all directions, and each of the frame members 2 is provided with an upper joint 3 and a lower joint 4. The device of the present invention can be applied to the tent having the constitution of FIGS. 1 and 2. The lower joint 4 of the device of the present invention is provided with a socket 10 at the end of a middle segment B of the frame member 2, and the opposite walls of the socket 10 is provided with a pair of pin holes 11 as shown in FIG. 4. Further, the socket 10 forms a recess 12, and, at the inner end of the recess 12, there is provided a supporting step 13.

A lower frame segment C is provided with a connecting portion 14. The connecting portion 14 is provided with a round projection 15 which is engaged with the supporting step 13 of the middle frame segment B, while the connecting portion 14 is also provided with an elongated slot 16 at a position corresponding to the pin hole 11.

The connecting portion 14 of the lower segment C is coupled with the socket 12 of the middle segment B, and a pin 18 is inserted into the pin hole 11 and the elongated slot 16 after aligning them, thereby joining the two segments B,C. Here, (as best shown in FIG. 4) the body of the pin 18 is hollow, and a rivet is inserted into the hollow space, so that the socket 10 and the connecting portion 14 can be connected together, and so that the pin 18 can be secured into the pin holes 11, thereby making it possible for it to move up and down within the elongated slot 16. At the neck of the lower segment C, a coil spring 19 is installed, with the lower end of the spring 19 being supported by an annular projection 20. The leading end of the spring is fitted with a cap shaped spring seat 21, and abuts to the tip of the socket 10 of the middle segment B.

The connecting portion 14 is inserted into the recess 12 of the socket 10, and can pivot around the pin 18 so as for the connecting portion 14 to advance and withdraw within the range of the elongated slot 16. When the tent is spread, as the segments move closer to each other by the compressing forces of the frame member, then the coil spring 19 is compressed. Under this condition, the round projection 15 of the connecting portion 14 is a abutted to the supporting step 13 of the connecting portion 14, and the pin 18 is positioned at the lower portion of the elongated slot 16 of the connecting portion 14. Meanwhile, when the tent is folded, as the compressing forces of the frame members are released, the compressed spring exerts a restoring force, so that the middle and lower segments B,C should depart from each other, thereby making it possible to easily fold the lower segment C as shown in FIG. 5. The reason is that the round projection 15 of the connecting portion 14, which has ben abutted to the supporting step 13 of the socket 10, departs from the step 13, and the pin 18 of the socket 10 is positioned in the upper portion of the elongated slot 16 of the connecting portion 14.

FIG. 7 illustrates a state in which the upper, middle and lower segments A,B,C exert compressing forces on each other toward joining portions H, as shown by the arrow marks. That is, when the tent is spread, and when the frame members are bent, the respective segments of the frame members exert forces toward the relevant joining portions H by the pulling action of the tent fabric. Owing to such a phenomenon, when the tent is spread, the middle segment B and the lower segment C are compressed toward each other as shown in FIG. 6, with the result that the round projection 15 is mounted upon the supporting step 13. Under this condition, the coil spring 19 is compressed, and, owing to the two securing points, i.e., the round projection 15 and the pin 18, the locking of the lower joint 4 is maintained, with the folding of the lower segment C being prevented. When the tent is kept spread continuously, the pulling action of the tent fabric continues, and therefore, the locked state of the lower joint 4 is continuously maintained. Under this condition, even if an external force is applied to the lower joint 4 or to the lower frame segment C, the lower joint can not be folded.

On the other hand, if the locked state of the upper joint 3 is released in order to fold up the tent, the pulling force of the tent fabric is released, and the compressed spring 19 exerts a restoring force, with the result that the two segments B,C depart from each other, thereby making it possible to fold the lower segment C in a V form.

Under this condition, the compression spring 19 which is accommodated into the cap shaped spring seat 21 (which is provided blow the connection portion 14 of the lower segment C) exerts extending forces so as for the connecting portion 14 to move downwardly, while the pin 18 of the lower joint 4 moves to the upper portion of the elongated slot 16. At the same time, the round projection 15 of the connecting portion 14 departs from the supporting step 13 which is formed between the walls of the socket 10 of the middle segment B of the lower joint 4. Thus the lower segment C moves upwardly as shown by the arrow mark of FIG. 5, so that the lower segment C should be folded upon into a V form. Thus, the lower segment C is folded into a V form, the folding point being the pin 18 which passes through holes 11 which are formed on the walls of the recess 12 of the socket 10.

Further, a part of the cross section of the connecting hole of each of the upper and lower joints are collapsed into a straight line, and the cross section of the frame member 2 to be fitted into the hole 22 is also collapsed into a straight line, with the result that the twisting of the frame members can be prevented.

According to the present invention constituted as described above, if the frame members 2 are unfolded, and thus if the upper joint 3 is locked, the lower joint 4 is also locked. Again, if the upper joint 3 is released from the locked state, the lower joint 4 is also released together. Therefore, the one touch effect remains same in the present invention as in the conventional one touch type tent, but adds another effect such that the locking or release of the lower joint 4 can be achieved with one touch manipulation, thereby giving a solution to the problem inherent to the conventional one touch type dome shaped tent.

What is claimed is:

1. A foldable frame for a dome shaped tent of the kind in which the tent fabric is supported within an external, outwardly bowed frame when the tent is erected, said foldable frame comprising, an upper, central hub, a plurality of foldable, outwardly bowable frame legs, each frame leg having an upper segment, a middle segment, and a lower segment, each frame leg having a hub pivot connection between the upper end of each upper segment and the central hub, each frame leg having an upper pivot means between the upper segment and the middle segment which permit the upper and middle segments to be bowed outwardly when the tent is erected and which permit the upper and middle segments to be folded inwardly in the shape of an inward V when the tent is folded and collapsed, each frame leg having manually actuated locking means for retaining the upper and middle segments locked together and bowed outwardly in the erected position of the tent and for releasing the segments for inwardly folding about the upper pivot means when the tent is to be collapsed and folded, each frame leg having lower pivot means between the middle segment and the lower segment for maintaining the middle and lower segments engaged and bowed outwardly when the upper and middle segments are locked together, and for spontaneously and automatically causing the middle and lower segments to disengage and to fold outwardly in the shape of an inverted V when the manually actuated locking means of the upper pivot means are actuated to release the upper and middle segments for inwardly folding of those two segments, said lower pivot means comprising, a pin interconnecting adjacent ends of the middle and lower segments for pivoting about the pin, a slot in the lower segment for permitting a limited amount of longitudinal shifting of the lower segment with respect to the pin and the middle segment, said slot having a lower end and an upper end complementary surfaces on the middle and lower segments, which complementary surfaces are engaged to hold the segments bowed out when the lower end of the slot is engaged with the pin by a downwardly acting force produced by locking the top and middle segments in the bowed out condition of those two segments, and spring biasing means for shifting the lower segment to a position in which the upper end of the slot is engaged with the pin and in which the complementary surfaces are moved out of engagement when the upper pivot means are unlocked and the resultant downwardly acting force is terminated.

2. The invention defined in claim 1 wherein the lower segment comprises two telescoping, relatively slidable parts at the spring biasing means and includes two flat, opposed surfaces for preventing any twisting of the two relatively slidable parts.

* * * * *